US008529175B2

(12) United States Patent
Edwards et al.

(10) Patent No.: US 8,529,175 B2
(45) Date of Patent: Sep. 10, 2013

(54) METHOD FOR TRANSPORTING CONCENTRATED MASS LOADS BY CONTAINER

(75) Inventors: Robert A. Edwards, Hamilton (CA); Tony Guo, Hamilton (CA)

(73) Assignee: Carego Innovative Solutions Inc. (CA)

( * ) Notice: Subject to any disclaimer, the term of this patent is extended or adjusted under 35 U.S.C. 154(b) by 0 days.

(21) Appl. No.: 13/282,236

(22) Filed: Oct. 26, 2011

(65) Prior Publication Data

US 2012/0097670 A1 Apr. 26, 2012

Related U.S. Application Data

(60) Provisional application No. 61/406,739, filed on Oct. 26, 2010.

(51) Int. Cl.
*B60P 7/12* (2006.01)

(52) U.S. Cl.
USPC ..... 410/49

(58) Field of Classification Search
USPC ..... 410/42, 47, 49
See application file for complete search history.

(56) References Cited

U.S. PATENT DOCUMENTS

| | | | | |
|---|---|---|---|---|
| 5,983,806 | A | 11/1999 | Brennan, Jr. et al. | |
| 6,379,107 | B1 * | 4/2002 | Iwasaki et al. | 414/809 |
| 2012/0097670 | A1 * | 4/2012 | Edwards | 220/1.5 |

FOREIGN PATENT DOCUMENTS

| | | |
|---|---|---|
| EP | 1123872 | 5/2005 |
| EP | 2447188 | 5/2012 |
| JP | 2000247392 | 9/2000 |
| WO | 2007012115 | 2/2007 |
| WO | 2008150162 | 12/2008 |

* cited by examiner

*Primary Examiner* — Hilary Gutman
(74) *Attorney, Agent, or Firm* — Banner & Witcoff, Ltd.

(57) ABSTRACT

A shipping apparatus for transporting a coil in a shipping container. The apparatus includes a saddle and a base. The saddle has angled supporting plates and lateral bars upon which said coil is placed. The saddle is placed on a base and may be releasably connected. The base is adapted to be slid while supporting the saddle and the coil, along the floor of said container to a transport position fully inside the container. When the coil, saddle, and base are in a container, the base distributes the load of the coil and the saddle to permit conventional transport of said container.

10 Claims, 10 Drawing Sheets

METHOD FOR TRANSPORTING CONCENTRATED MASS LOADS BY CONTAINER

CROSS REFERENCE TO RELATED APPLICATIONS

This application claims priority to U.S. Provisional Application No. 61/406,739, filed Oct. 26, 2010. This application is incorporated herein by reference in its entirety.

TECHNICAL FIELD

The present invention relates to the transportation of concentrated mass loads by container and apparatus for use in transporting concentrated mass loads by container. The invention has application to the transportation of, inter alia, steel coils, up to 53,000 lbs. in weight.

BACKGROUND

It is known to ship steel coils by container. However, placing, for example, a 53,000 lb coil of steel upright on a conventional pallet would impart localized loading on a standard container floor which would exceed its design capacity. As well, although open frame containers have been developed which permit side loading or loading by way of a crane, there are relatively few of these containers in circulation. Accordingly, known methods for shipping steel coils often involve relatively expensive, bulky pallets which are loaded with coils, which are slid or rolled into a container for use and which spread the load of the coils over the container floor.

SUMMARY

Apparatus for transporting a coil in a shipping container forms one aspect of the invention and comprises: a saddle upon which said coil is placed and which supports said coil in use; and a base upon which said saddle is placed and which supports and is releasably connected to said saddle in use, the base being adapted to be slid, while supporting the saddle and said coil, along the floor of said container to a transport position fully inside said container whereat the base distributes the load of said coil and the saddle to permit conventional transport of said container.

According to another aspect of the invention: the base can be adapted to permit a plurality of said bases to be arranged in a stack; and the saddle can be adapted to permit a plurality of said saddles to be arranged in a stack.

According to another aspect of the invention: the base and saddle can be adapted such that, when the saddle is supported by the base and the base is in the transport position, the saddle and base mechanically engage one another such that sliding motion of the saddle with respect to the base is restrained; and when the base is in the transport position, the saddle is upon the base and the coil is upon the saddle, the saddle can surround the sides of the coil to restrain horizontal sliding motion of the coil with respect to the saddle and the base.

According to another aspect of the invention, the base and saddle can be adapted such that, when the saddle is supported by the base and the base is positioned on the floor of said container with a portion of said base, including the portion underlying said saddle, disposed exteriorly of said container, said coil can be placed upon said saddle by a conventional lift truck with a conventional coil lifter of the type having a bar projecting from the front of the lift truck which engages the central bore of the coil during said placement.

According to another aspect of the invention, when the saddle is disposed upon the base, the base is in the transport position and the coil is supported by the saddle, the central bore of the coil can extend lengthwise with respect to said container.

According to another aspect of the invention, the apparatus can further comprise a base extender adapted to be releasably coupled to the base to form an assembly, the assembly being adapted such that at least when the base is in the transport position and the doors of the container are closed, the assembly is restrained by the container against sliding movement along the floor.

According to another aspect of the invention, the adaptation which provides for the assembly to be restrained by the container against sliding movement along the floor at least when the base is in the transport position and the doors of the container are closed comprises portions of the base and base extender which engage with the corner posts of the container in use.

According to other aspects of the invention, a handle can be pivotally coupled to the base for movement between a storage position and a shuttle position. At the storage position, when the saddle is supported by the base and the base is positioned on the floor of said container with a portion of said base, including the portion underlying said saddle, disposed exteriorly of said container, said coil can be placed upon said saddle, with the central bore of the coil extending lengthwise with respect to said container, by a conventional lift truck with a conventional coil lifter of the type having a bar projecting from the front of the lift truck which engages the central bore of the coil during said placement. At the shuttle position, the handle can present an aperture. The handle can be adapted such that, when the base is in the transport position, the saddle is upon the base, the coil is upon the saddle and the handle is in the shuttle position, the lifter of said conventional lift truck can engage said handle to drag the base, saddle and handle from the container.

According to another aspect of the invention, the base can be adapted to be slid along the floor of said container to the transport position by force applied to said handle by said lift truck after said coil has been placed on the saddle.

Forming another aspect of the invention is a method comprising the steps of: transporting a plurality of coils using a plurality of the apparatus from a shipping destination; removing the coils from the saddles following transport; with respect to each apparatus, disconnecting the saddle from the base to provide a plurality of bases and a plurality of saddles; and arranging the bases in one or more stacks, arranging the saddles in one or more stacks and returning the stacked bases and stacked saddles by container to the shipping destination.

Other advantages of the present invention will become evident upon review of the accompanying detailed description and drawings, the latter being briefly described hereinafter.

BRIEF DESCRIPTION OF THE DRAWINGS

Illustrative aspects in accordance with the invention will be described in detail with reference to the following figures wherein.

DETAILED DESCRIPTION

Figure 1:
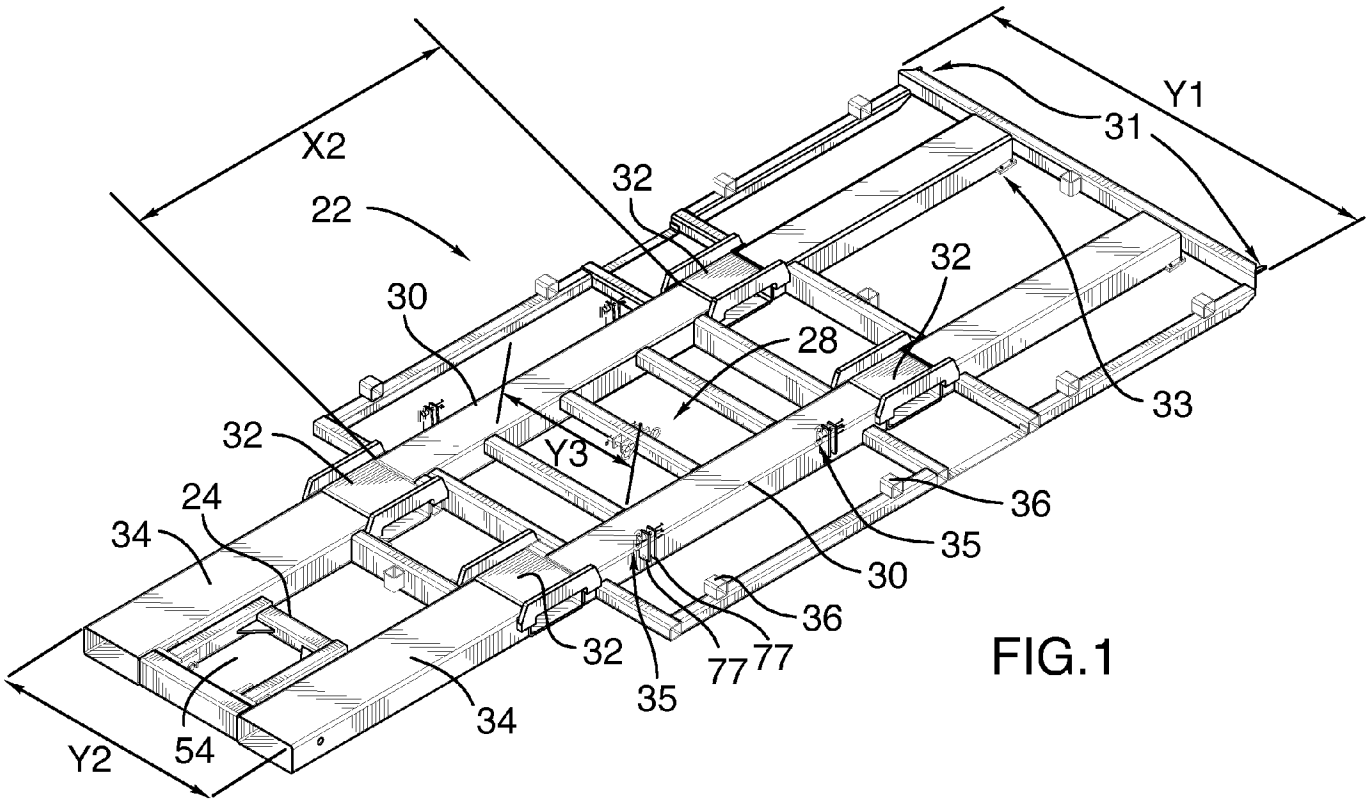
FIG. 1 is a perspective view of the base and handle of the exemplary embodiment.
Figure 2:
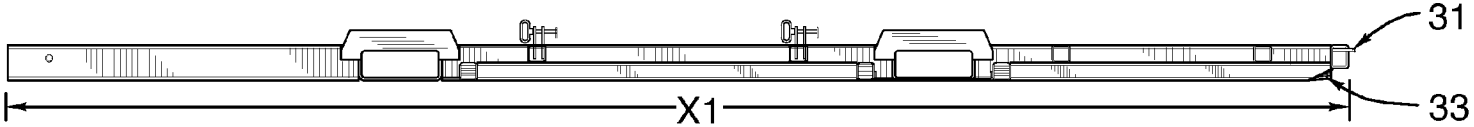
FIG. 2 is a side view of the structure of FIG. 1.
Figure 3:
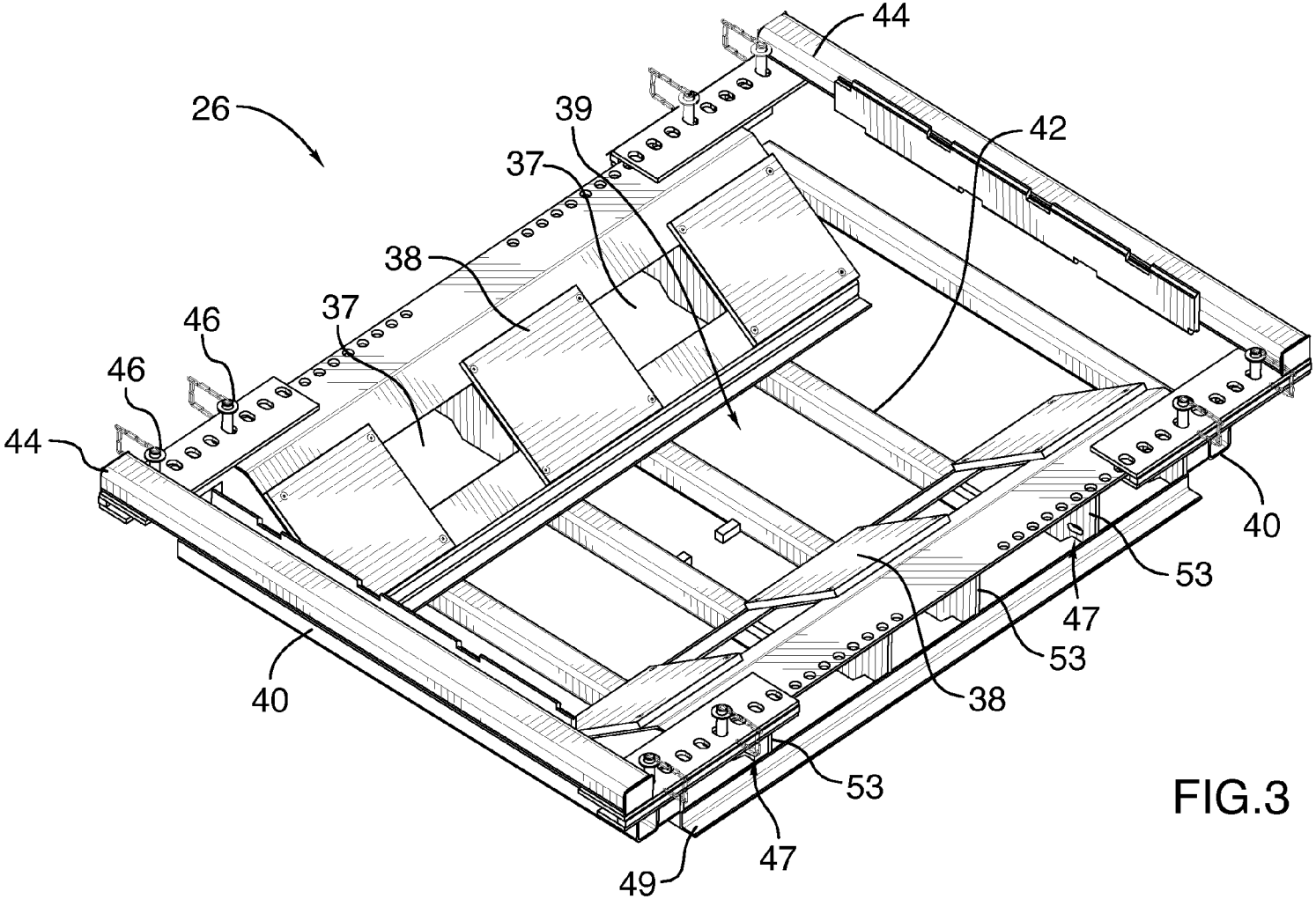
FIG. 3 is perspective view of the saddle of the exemplary embodiment.
Figure 4A:
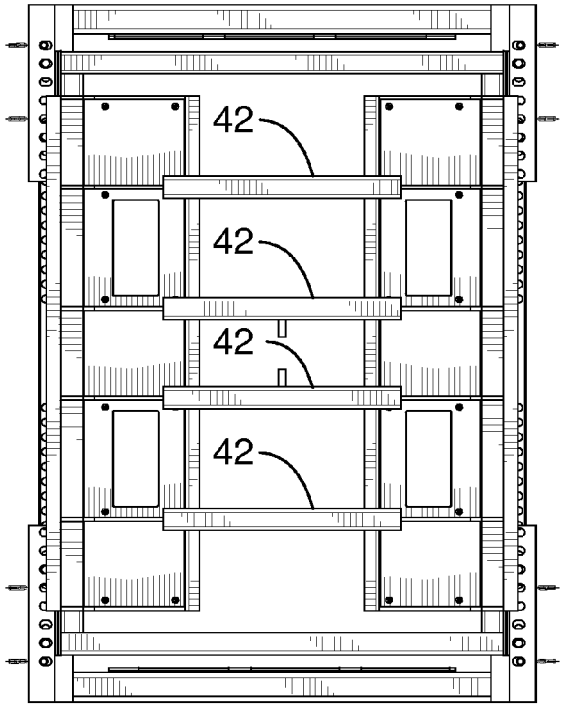
FIG. 4A is a top plan view of the structure of FIG. 3.
Figure 4B:
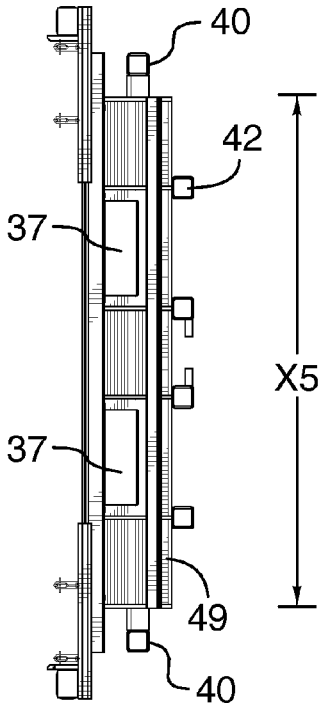
FIG. 4B is a side view of the structure of FIG. 3.
Figure 5:
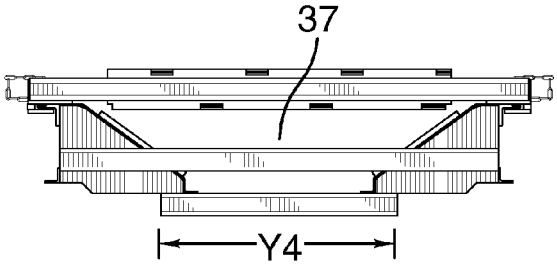
FIG. 5 is an end view of the structure of FIG. 3.

Exemplary apparatus for transporting a coil in a shipping container is described hereinafter with general reference to FIGS. 1-13 but, as an initial matter, the exemplary apparatus should be understood to comprise three main components, namely, a base 22 and a handle 24, as shown in FIGS. 1-2, and a saddle 26, as shown in FIGS. 3-5.

With reference to FIGS. 1-2, the base 22 will be seen to be a generally planar, rigid, framework structure formed of welded steel and to have a width Y1 slightly less than the width of the interior floor of a conventional shipping container and a length X1 slightly less than the length of said interior floor. Longitudinal 30 and lateral 32 members form part of the base 22. Interiorly of longitudinals 30 is a plurality of sockets 28, each having a width Y3. The laterals 32 are spaced apart a distance X2 and are slightly thicker than longitudinals 30. One end of base 22 will be seen to be defined by a pair of projecting longitudinal members 34, spaced apart from one another such that their exterior surfaces are a distance Y2 from one another. Also forming part of base 22 is a plurality of lugs 36 which are distributed about and rigidly secured to the framework. Two lateral guide wedges 31 and two sliding pads 33 are provided on the base 22. The sliding pads 33 are ultra high molecular weight polyethylene. Also provided on the base 22 is a plurality of flanges 77, arranged in pairs, with each pair 77,77 having a pin 35 extending therethrough.

The handle 24 is a rectangular frame of steel, nested between and pivotally mounted to the projecting longitudinals 34 and is shown in FIGS. 1-2 in a storage configuration.

With reference to FIGS. 3-5, the saddle 26 is another rigid, welded steel structure characterized in this embodiment by spaced-apart, opposed, planar elements 38 disposed in angular relation to one another to define a cavity 39. Flanking planar elements 38 is a pair of upper laterals 40 and disposed beneath planar elements 38 are four lower laterals 42, each having a length Y4 substantially equal to the socket width Y3. Outriggers 49 connect the lower laterals 42 and have a length X5 substantially equal to distance X2. A pair of cross-members 44 is also provided, each being spaced above a respective one of the upper laterals 40 and being operatively releasably secured to planar elements 38 by locking pins 46. On the underside of saddle 26, a plurality of ridges 53 are defined, and slots 47 are defined in four of these ridges 53.

The first channel 20 is provided with a threaded bore 34 which extends inwardly into the component 12, 14 in a direction generally perpendicular to the side 18 of the fascia 16 and is configured to receive a threaded fastener such as a screw or bolt to retain a connector received in the first channel 20, for example when two stacked components are to be locked together, as will be described below.

Figure 6:
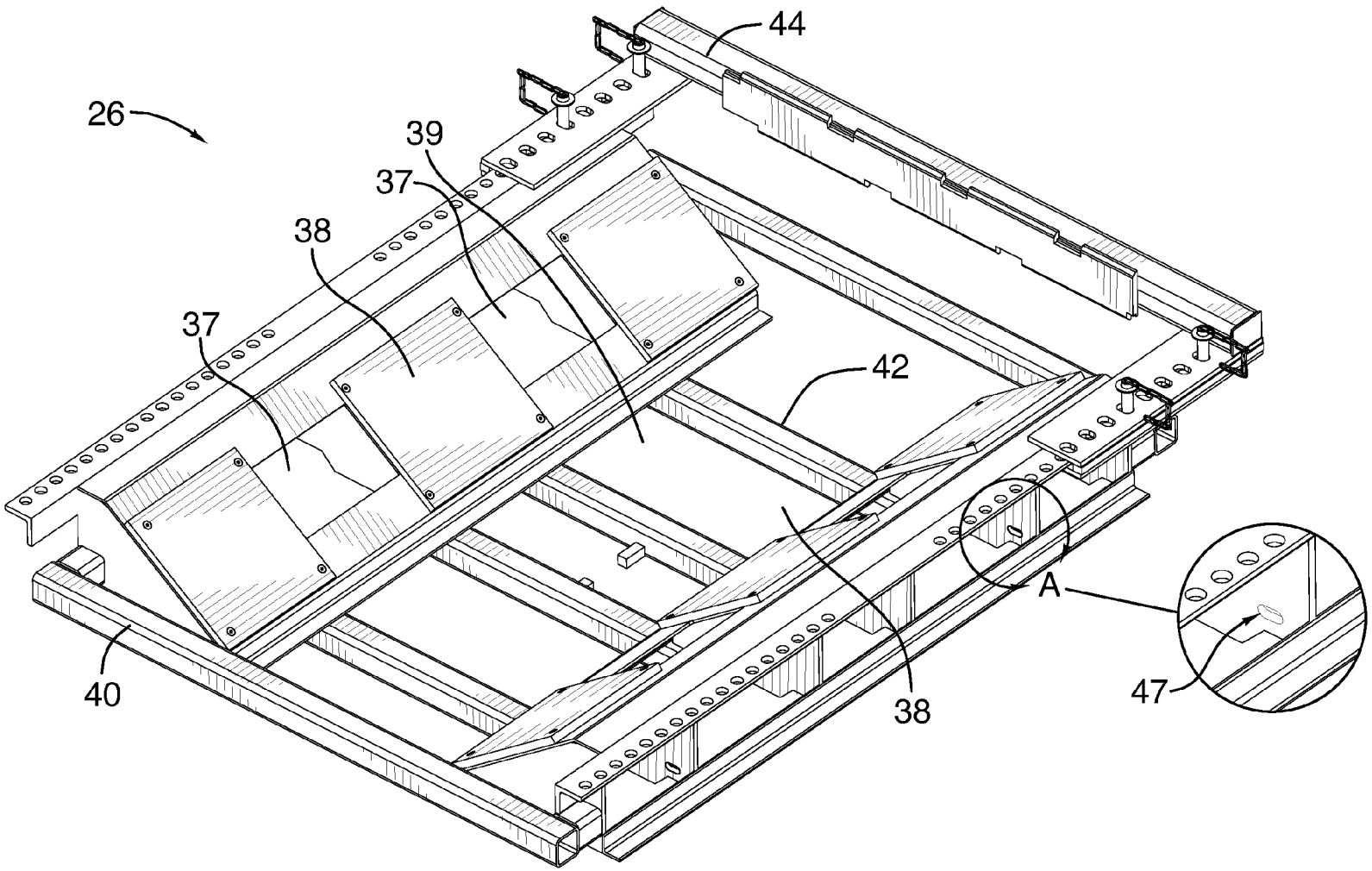
FIG. 6 is a view similar to FIG. 3, but with a portion removed.

For use (not shown):

- the base 22 is orientated such that the lugs 36 present upwardly and pins 35 are removed;
- the saddle 26 is positioned, using a conventional lift truck, with the lower laterals 42 each engaging a respective socket 28, with the outriggers 49 captured between laterals 32 of the base 22 and with the ridges 53 fitted in the paired flanges 77;
- the saddle 26 is secured to the base 22 by passing pins 35 through slots 47 and ridges 53;
- the base 22 is positioned on the floor of a shipping container with a portion of said base 22, including the portion underlying said saddle 26, disposed exteriorly of said container; and
- cross-member 44 nearest the handle 24 is removed, as suggested by the sequence of FIGS. 3,6.

Figure 7:
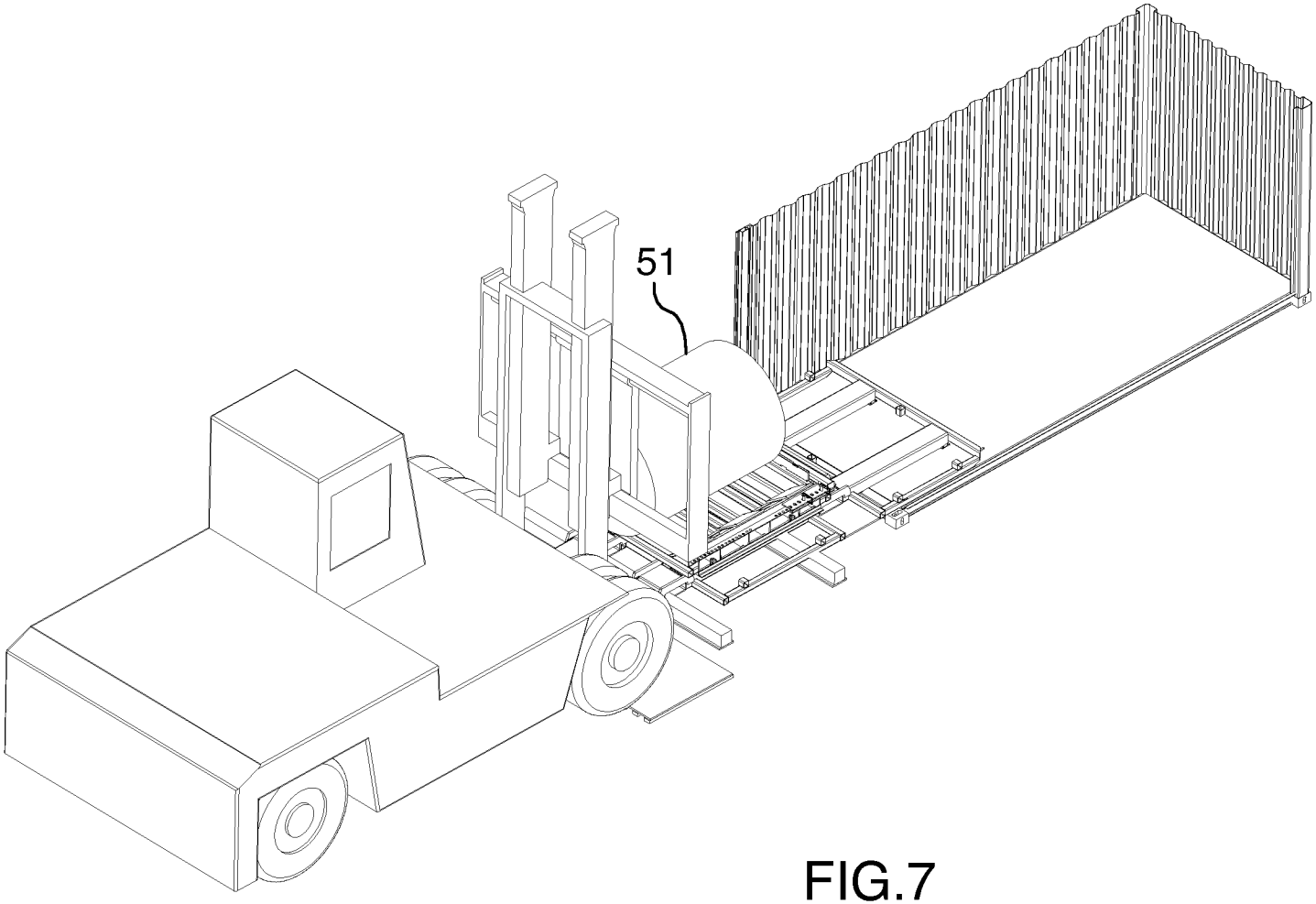
FIG. 7 is a perspective view of the structure of FIG. 1 in use with the structure of FIG. 6, showing a coil being loaded onto the saddle.
Figure 8:
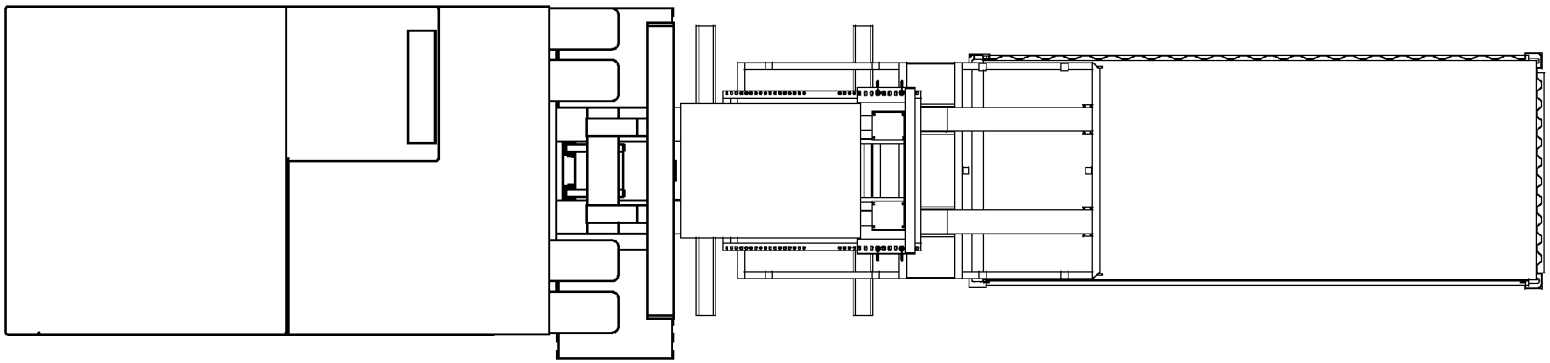
FIG. 8 is a top plan view of the structure of FIG. 7.
Figure 9:
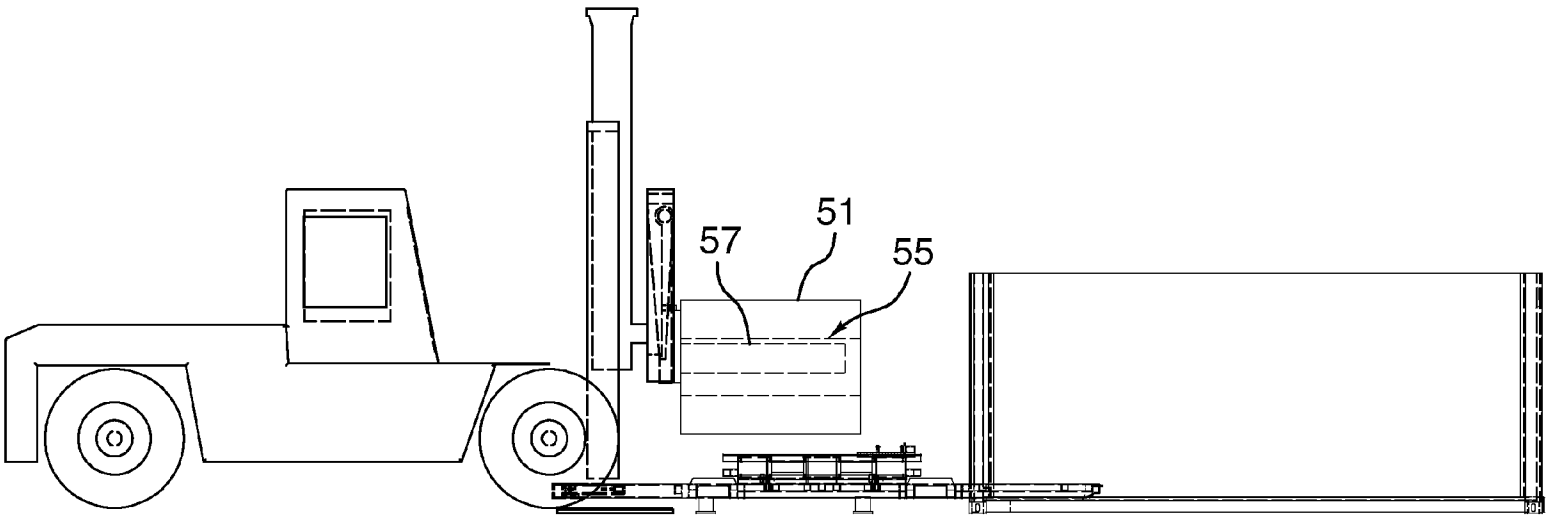
FIG. 9 is a side view of the structure of FIG. 7.

Thereafter, a conventional lift truck with a coil lifter, of the type having a bar 57 projecting from the front of the lift truck, can be used to engage the central bore 55 of a steel coil 51 and place said coil in the cavity 39 with the bore 55 extending longitudinally within respect to the container, all as shown in FIGS. 7-9.

With the coil 51 so placed, straps 48 can be used to securely lash the coil 51 to the base, via the lugs 36, thereby to keep the coil 51 in the cavity 39. The cross-member 44 previously removed can be also repositioned and secured in place. As persons of ordinary skill will readily appreciate, with the cross-members 44 in position, the saddle 26 surrounds the sides of the coil 51 to restrain horizontal sliding motion of the coil 51 with respect to the saddle 26 and the base 22. Similarly, the saddle 26 is grippingly received by the base 22, namely, by engagement of the lower laterals 42 in the sockets 28, to restrain against sideways sliding motion of the saddle 26 with respect to the base 22, and by engagement of the outriggers 49 between laterals 32, to restrain against lengthwise sliding motion of the saddle 26 with respect to the base 22.

Figure 10:
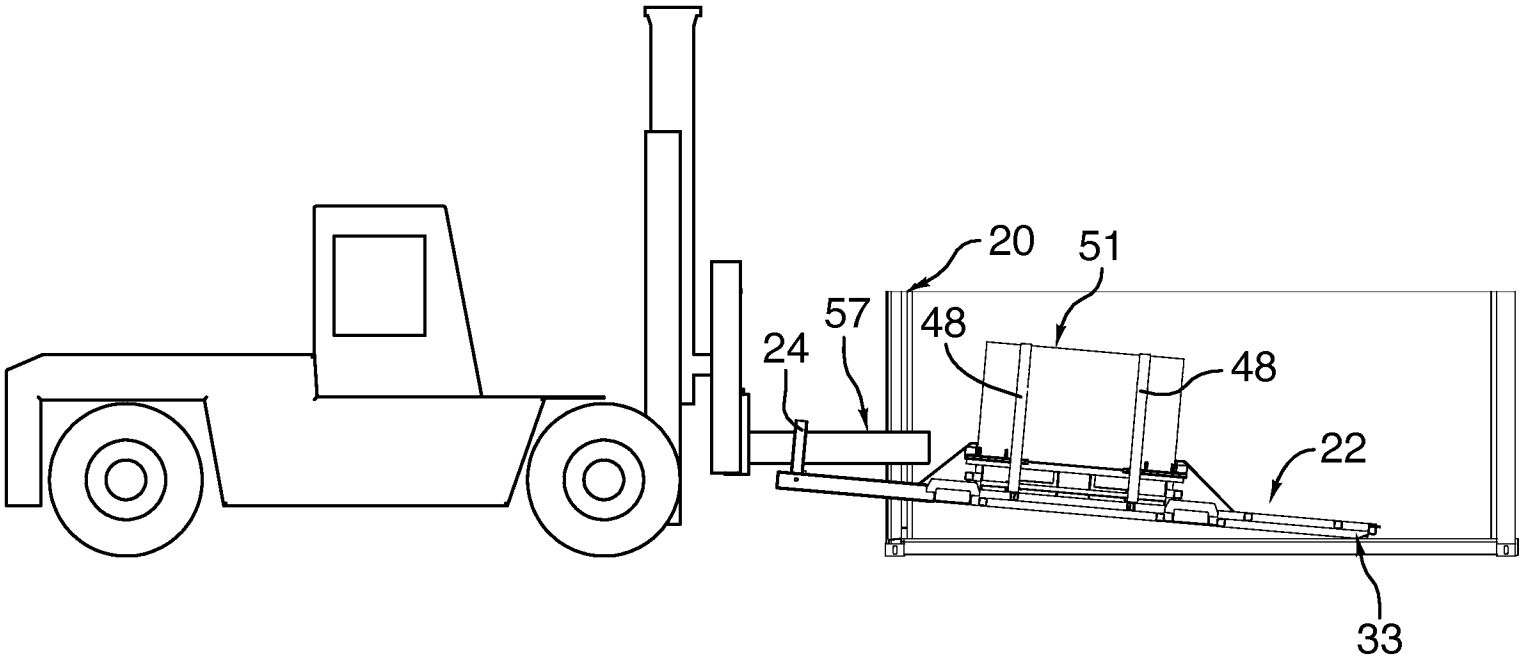
FIG. 10 is a view of the structure of FIG. 1 in use with the structure of FIG. 3, showing the apparatus being placed into the container.

The lift truck can then be used, as shown in FIG. 10, to apply pressure to the handle 24 to slide the base 22 along the floor of said container to a transport position fully inside said container whereat the base 22 distributes the load of said coil 51 and the saddle 26 to permit conventional transport of said container. As the base slides along the container, only the surfaces of the two sliding pads 33 are in contact; the self-lubricating nature of the pads 33 facilitates this motion.

Figure 11:
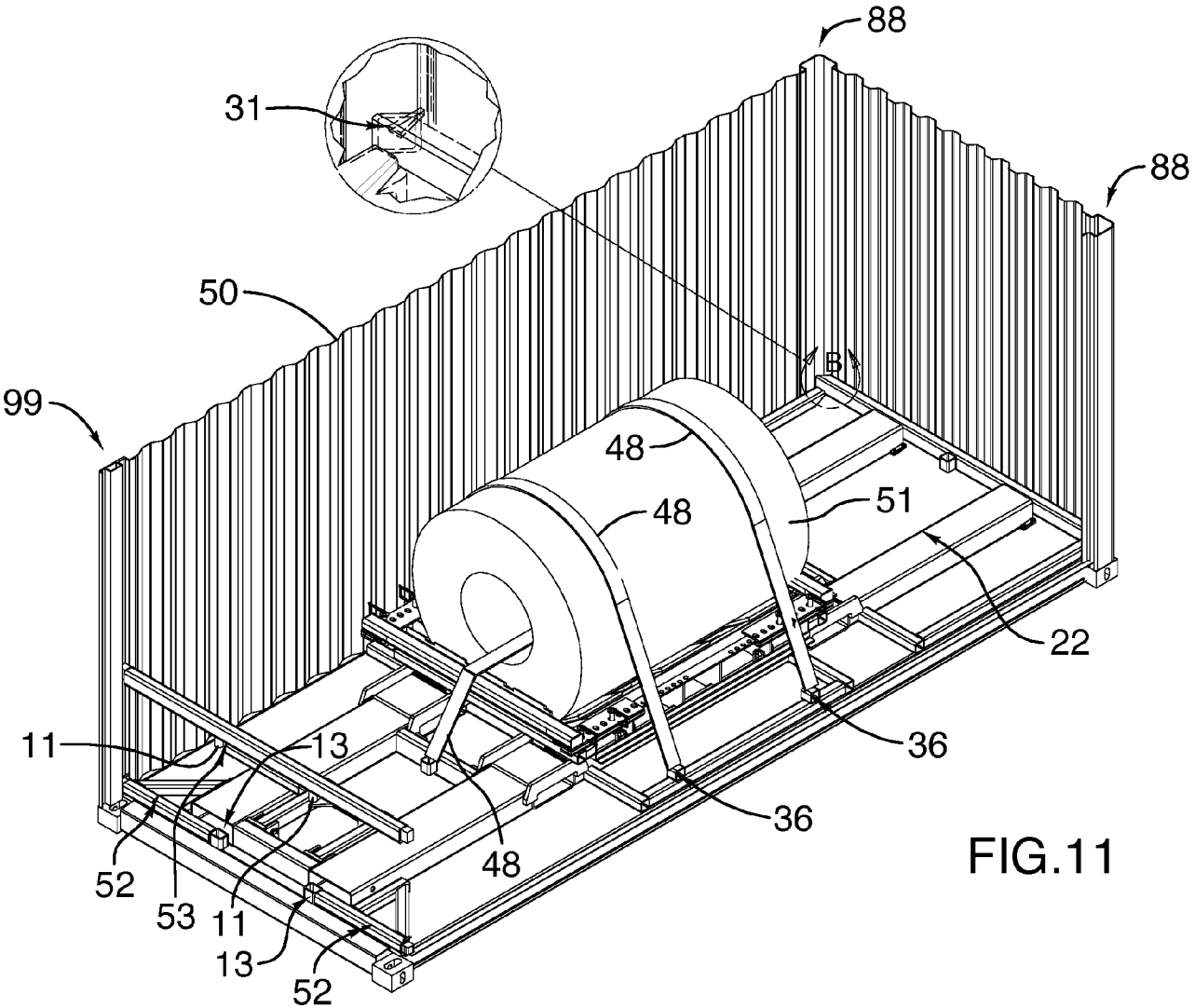
FIG. 11 is a view of the structure of FIG. 1 and the structure of FIG. 3 in use.

Once the base is positioned at the transport position, two bracing blocks 52 are positioned and secured together by a bracing bar 53, all as shown in FIG. 11, to form an assembly (bracing bar 53 is shown elevated in relation to blocks 52, for clarity, but, in use, would be lowered, such that pins 11 on the underside of bar 53 engage pockets 13 on blocks 52. So configured, it will be appreciated that:

- lateral guide wedges 31 engage the front posts opposite the door of the container (indicated by 88 but not shown) to resist frontward sliding motion of the base, and sideways sliding motion of the front of the base; and
- the bracing blocks 52 and bracing bar 53 define a base extender that engages the rear posts adjacent the door of the container (only one post being shown, that post being indicated by 99) to resist rearward sliding motion of the base and sideways sliding motion of the rear of the base.

Following transport, that is, once the container has reached the ultimate destination, bracing blocks 52 and bracing bar 53 are removed and the base, saddle are coil are dragged from the container via the handle 24, in a manner analogous but reverse to the operation shown in FIG. 10.

Once the base has been dragged from the container a distance sufficient to clear the saddle 26 from the container and provide access to the coil 51, the straps 48 and cross-members 44 are removed and the coil 51 is removed by a lift truck, i.e. generally as illustrated in FIGS. 7-9 in the context of loading.

Figure 12:
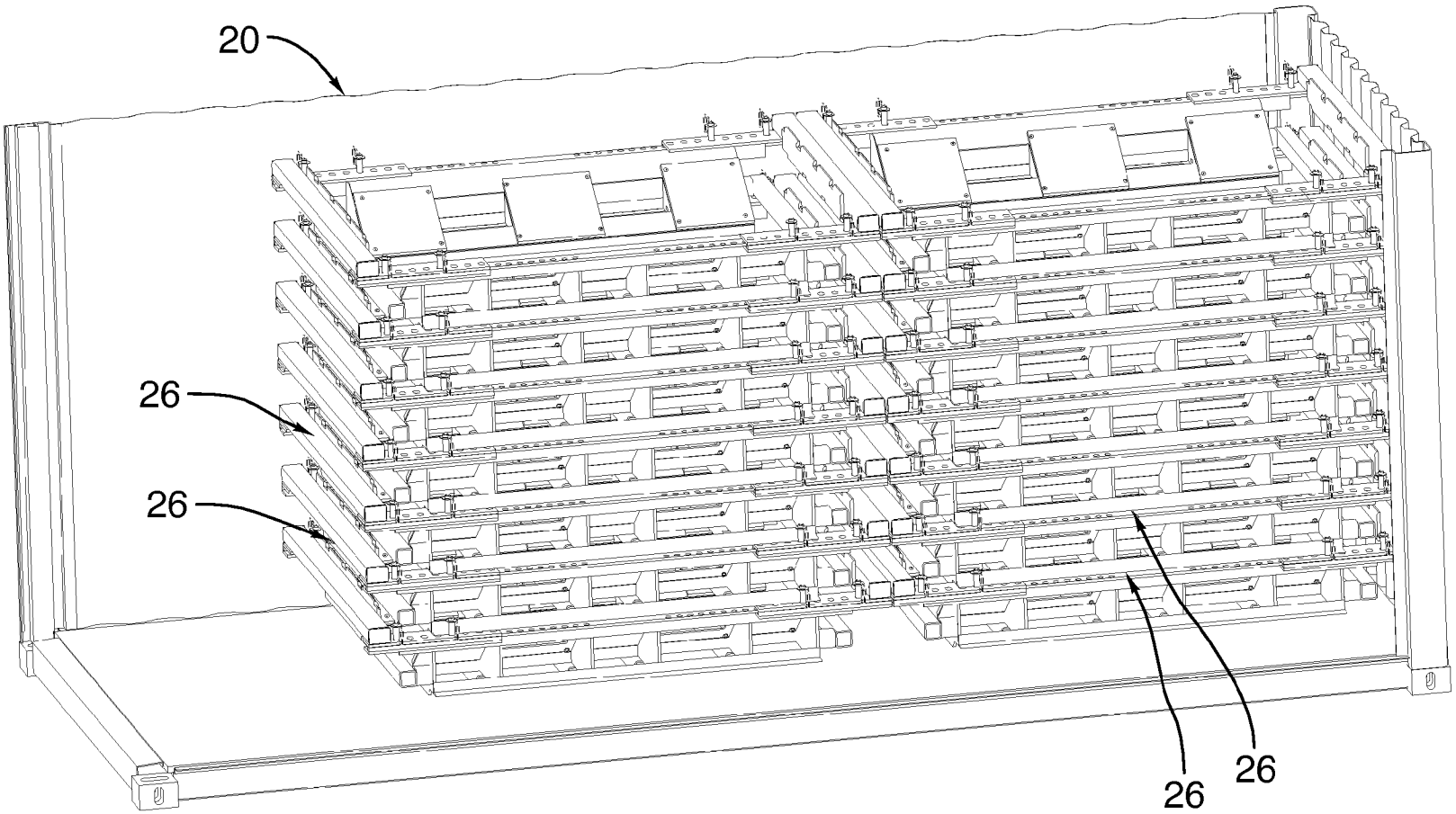
FIG. 12 is a view of a plurality of the structure of FIG. 3 arranged in stacks in a container.
Figure 13:
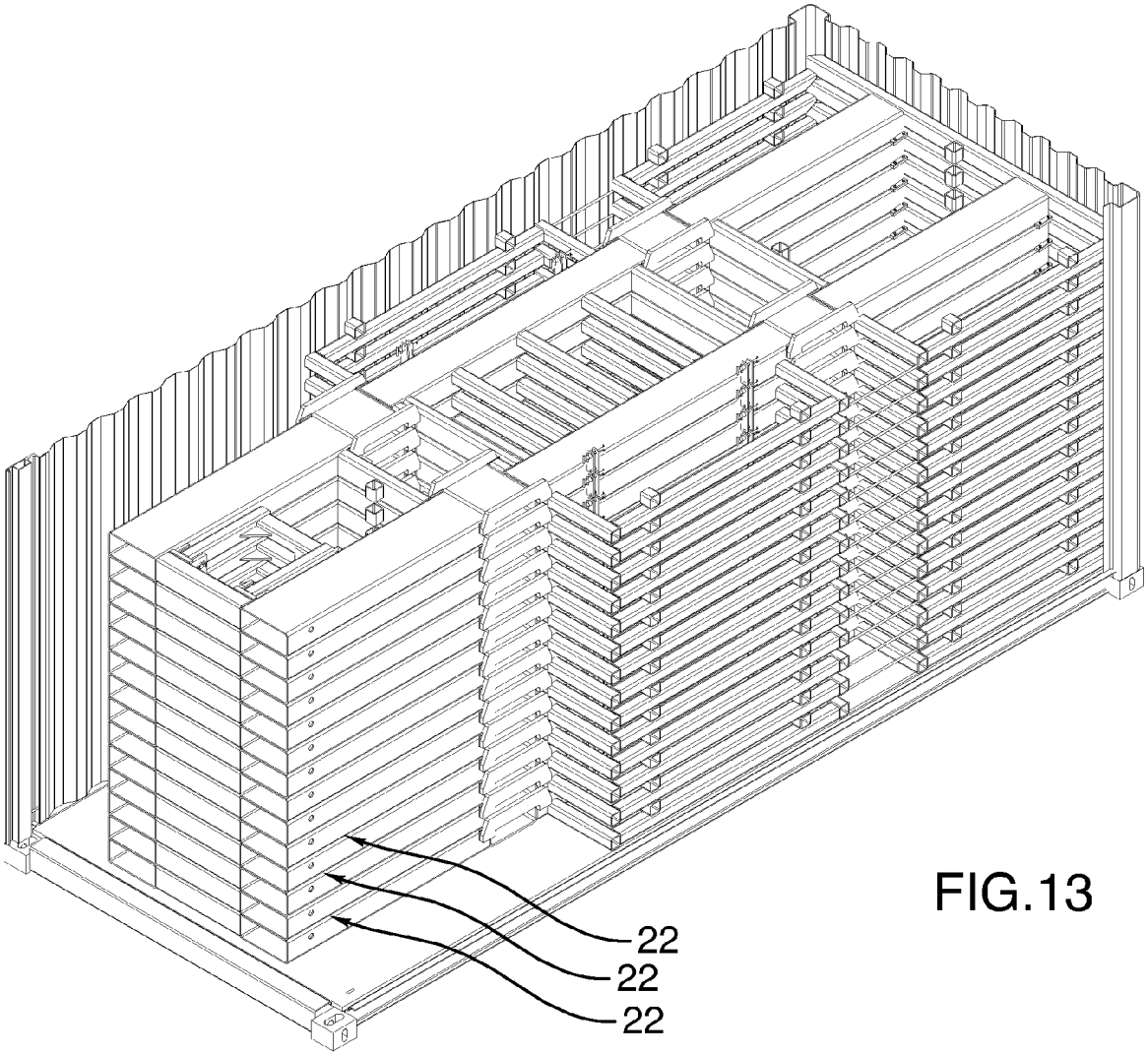
FIG. 13 is a view of a plurality of the structure of FIG. 1 arranged in a stack in a container.

If the coil shipment in question is a 'one-off' type of transaction, the apparatus can be returned to the container and shipped back to the originator. However, in the context of a facility which receives coils regularly, once the coil has been removed from an apparatus, the saddle can be removed from the base, and the bases and saddles can be stacked and returned to the originator by container in bulk, as illustrated in FIG. 12 and FIG. 13.

As persons of ordinary skill will readily appreciate, the exemplary apparatus achieves an advantageous combination in terms of relatively low cost to manufacture, and relatively low cost to return ship in bulk.

Whereas a single exemplary embodiment is illustrated and described in use, various modifications are possible.

For example, whereas it is specified that the lift truck is used to apply pressure to the handle to cause translation of the base, this is not necessary; pressure could, for example, be applied directly to, for example, projecting longitudinals 34.

Further, whereas in the exemplary embodiment, portions of the base and the saddle mechanically interact with one another to resist relative sliding movement, this is not strictly necessary; the base and saddle could, for example, be held against relative sliding movement by bolts or the like.

Similarly, whereas it is specified that, for loading and unloading, the saddle is disposed exteriorly of the container, this is also not necessary: the saddle could be disposed partially in the container, but this would add slightly to the effort associated with installation of the cross-members after coil placement.

Further, whereas a specified structure for the base and saddle is shown, it will be appreciated that persons of ordinary skill in the art could utilize other frame structures, with similar utility.

What is claimed is:

1. Apparatus for transporting a coil in a shipping container, the apparatus comprising:

a saddle upon which said coil is placed and which supports said coil in use; and a base upon which said saddle is placed and which supports and is releasably connected to said saddle in use, the base being adapted to be slid, while supporting the saddle and said coil, along the floor of said container to a transport position fully inside said container whereat the base distributes the load of said coil and the saddle to permit conventional transport of said container.

2. Apparatus according to claim 1, wherein the base is adapted to permit a plurality of said bases to be arranged in a stack and the saddle is adapted to permit a plurality of said saddles to be arranged in a stack.

3. Apparatus according to claim 1, wherein the base and saddle are adapted such that, when the saddle is supported by the base and the base is in the transport position, the saddle and base mechanically engage one another such that sliding motion of the saddle with respect to the base is restrained; and when the base is in the transport position, the saddle is upon the base and the coil is upon the saddle, the saddle surrounds the sides of the coil to restrain horizontal sliding motion of the coil with respect to the saddle and the base.

4. Apparatus according to claim 1, wherein the base and saddle are adapted such that, when the saddle is supported by the base and the base is positioned on the floor of said container with a portion of said base, including the portion underlying said saddle, disposed exteriorly of said container, said coil can be placed upon said saddle by a conventional lift truck with a conventional coil lifter of the type having a bar projecting from the front of the lift truck which engages the central bore of the coil during said placement.

5. Apparatus according to claim 4, wherein when the saddle is disposed upon the base, the base is in the transport position and the coil is supported by the saddle, the central bore of the coil extends lengthwise with respect to said container.

6. Apparatus according to claim 1, further comprising a base extender adapted to be releasably coupled to the base to form an assembly, the assembly being adapted such that at least when the base is in the transport position and the doors of the container are closed, the assembly is restrained by the container against sliding movement along the floor.

7. Apparatus according to claim 6, wherein the adaptation which provides for the assembly to be restrained by the container against sliding movement along the floor at least when the base is in the transport position and the doors of the container are closed comprises portions of the base and base extender which engage with the corner posts of the container in use.

8. Apparatus according to claim 1, further comprising a handle pivotally coupled to the base for movement between: a storage position, whereat, when the saddle is supported by the base and the base is positioned on the floor of said container with a portion of said base, including the portion underlying said saddle, disposed exteriorly of said container, said coil can be placed upon said saddle, with the central bore of the coil extending lengthwise with respect to said container, by a conventional lift truck with a conventional coil lifter of the type having a bar projecting from the front of the lift truck which engages the central bore of the coil during said placement; and a shuttle position whereat the handle presents an aperture, the handle being adapted such that, when the base is in the transport position, the saddle is upon the base, the coil is upon the saddle and the handle is in the shuttle position, the lifter of said conventional lift truck can engage said handle to drag the base, saddle and handle from the container.

9. Apparatus according to claim 8, wherein the base is adapted to be slid along the floor of said container to the transport position by force applied to said handle by said lift truck after said coil has been placed on the saddle.

10. Method comprising the steps of:

transporting a plurality of coils using a plurality of apparatuses from a shipping destination, each apparatus comprising:

a saddle upon which a coil is placed and which supports said coil in use; and a base upon which said saddle is placed and which supports and is releasably connected to said saddle in use, the base being adapted to be slid, while supporting the saddle and said coil, along the floor of said container to a transport position fully inside said container whereat the base distributes the load of said coil and the saddle to permit conventional transport of said container;

removing the coils from the saddles following transport with respect to each apparatus;

disconnecting the saddle from the base to provide a plurality of bases and a plurality of saddles; and arranging the bases in one or more stacks, arranging the saddles in one or more stacks and returning the stacked bases and stacked saddles by container to the shipping destination.

* * * * *